United States Patent [19]

Naderi et al.

[11] 4,215,886

[45] Aug. 5, 1980

[54] ANIMAL LITTER COLLECTOR

[76] Inventors: Iraj Naderi; Mahboobeh Naderi, both of 1865 211th St., Bayside, N.Y. 11360

[21] Appl. No.: 935,289

[22] Filed: Aug. 21, 1978

[51] Int. Cl.[2] ..... A47I 13/52

[52] U.S. Cl. ..... 294/1 B

[58] Field of Search ..... 294/55, 1 R, 19 R, 1 B; 229/1.5 R, 16 R, 18, 22, 41 B, 52 B; 15/257.1, 257.5, 104.8; 119/1 R; 206/223, 527

[56] References Cited

U.S. PATENT DOCUMENTS

| | | | |
|---|---|---|---|
| 3,813,121 | 5/1974 | Marvin | 294/1 R |
| 3,850,467 | 11/1974 | Johnson | 294/1 R |
| 3,885,266 | 5/1975 | Nafzinger | 294/1 R |
| 4,103,952 | 8/1978 | Thompson | 294/55 |

*Primary Examiner*—James B. Marbert

*Attorney, Agent, or Firm*—Allison C. Collard; Thomas M. Galgano

[57] ABSTRACT

A disposable animal litter collector comprising a shovel-type scoop having a flat supporting surface with a leading edge defining the opening of the scoop, vertical sidewalls on each side of the support surface, and a back wall joining the vertical sidewalls. There is a flexible bag having an opening at one end and closed at its opposite end, and joined to the back end of the scoop. A scraper is also provided so that the litter can be pushed onto the scoop and the bag pulled over the entire scoop and sealed for disposal.

2 Claims, 5 Drawing Figures

ANIMAL LITTER COLLECTOR

This invention relates to an improved animal litter collector.

More specifically, this invention relates to a disposable animal litter collector, which can be used simply and neatly and which is disposable after each use.

Recent codes enacted by city and state municipalities now ban any littering by pets or animals. Pet owners are now required to collect the animal litter as soon as it is deposited on streets or sidewalks in many cities and towns.

Many pet owners carry a shovel or some other heavy implement with them in order to conform with village or city requirements. There are also a number of conventional litter scooping devices, which generally include a long handle with a receptacle at one end for assisting in the collection of the animal litter. These conventional devices suffer from the disadvantage of often being heavy or they cannot be collapsed or carried in a pocket before being used. Some of the conventional devices also are not disposable, and therefore require the owner to clean the litter from the device before it is reused.

Accordingly, the present invention provides a compact, portable and disposable animal litter collector, which can be carried in the pocket of the user and can be deployed when necessary to collect the animal litter and dispose of it in the nearest trash receptacle. The invention utilizes a cardboard triangularly-shaped scoop attached to a plastic bag and a scraper tool, so that when the animal litter is scraped into the scoop, the plastic bag can be fitted over the scoop, and the entire contents disposed of. In addition, the hand of the user is protected by the bag while the litter is being collected.

It is therefore an object of the present invention to provide a compact, disposable animal litter collector, which consists of a trough-shaped scoop and a scraper in combination with a plastic enclosure bag.

It is another object of the present invention to provide an animal litter collector, which is simple in design, inexpensive in cost, and reliable in operation.

Other objects and features of the present invention will become apparent from the following detailed description considered in connection with the accompanying drawings, which disclose the features of the invention. It is to be understood, however, that the drawings are designed for the purpose of illustration only, and not as a definition of the limits of the invention.

In the drawings wherein similar reference characters denote similar elements throughout the several views.

Figure 1:
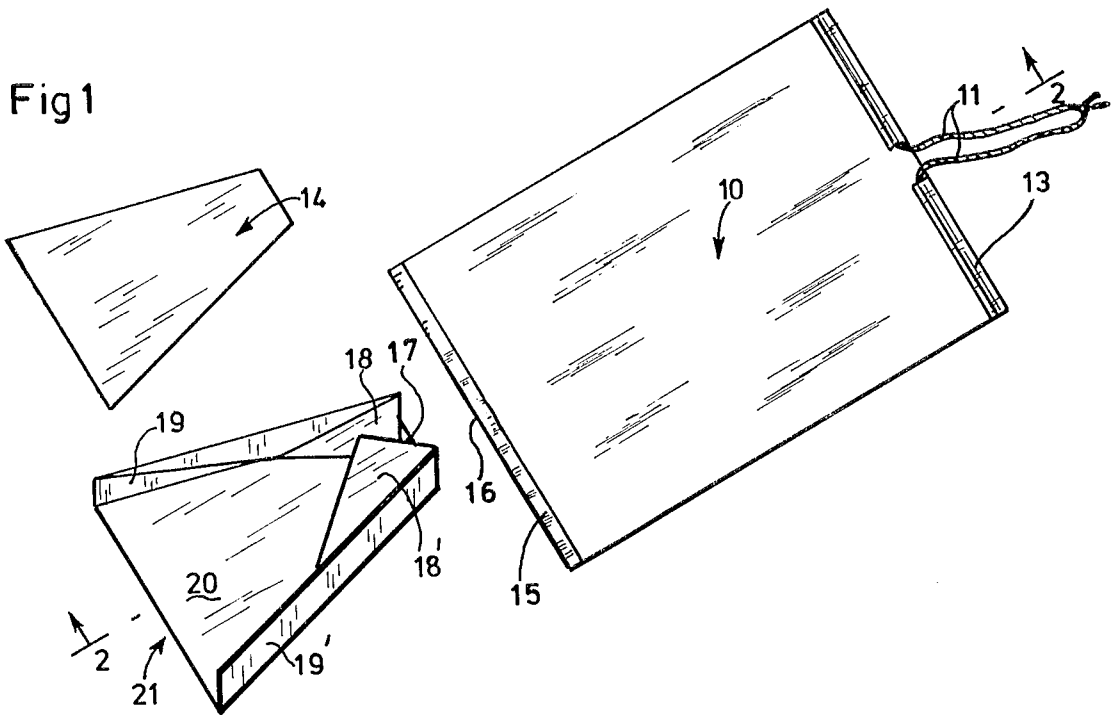
FIG. 1 is a plan view of the elements of the animal litter collector, according to the invention.
Figure 2:
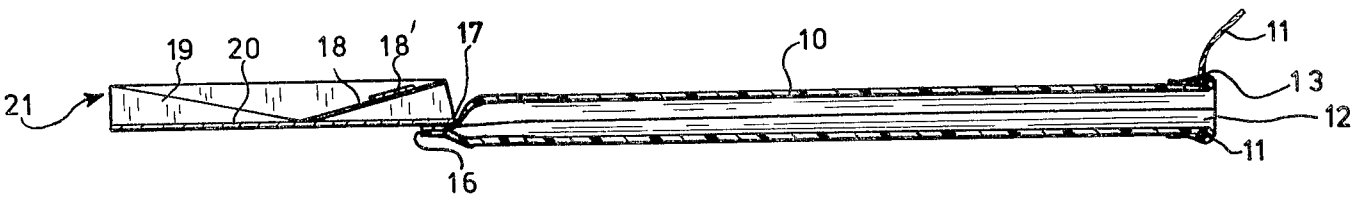
FIG. 2 is a cross-sectional view taken through section II—II of FIG. 1.
Figure 3:
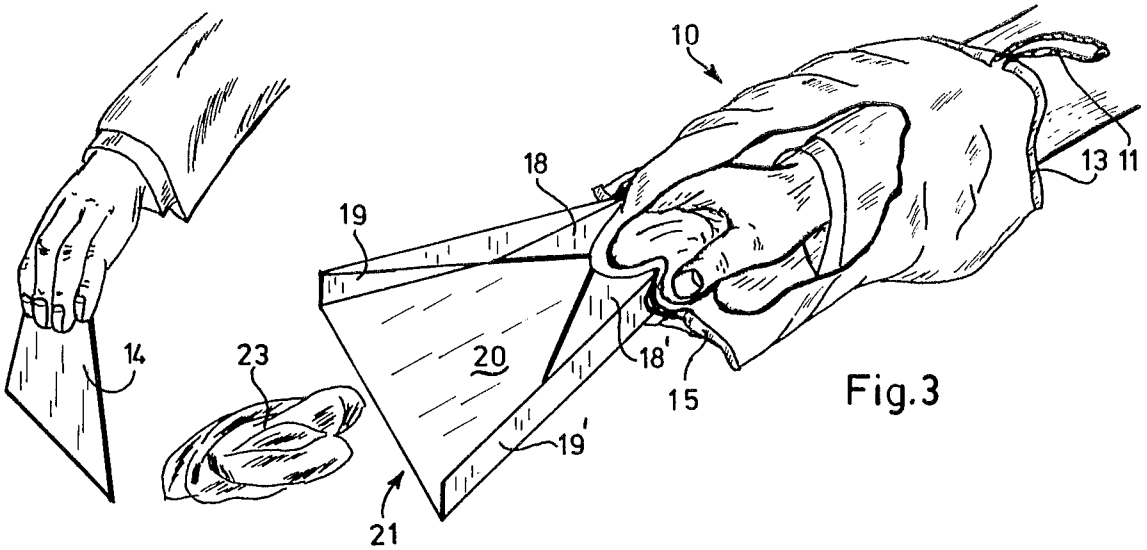
FIG. 3 is a perspective view, partly in cross-section, showing the operation of the litter collector.
Figure 4:
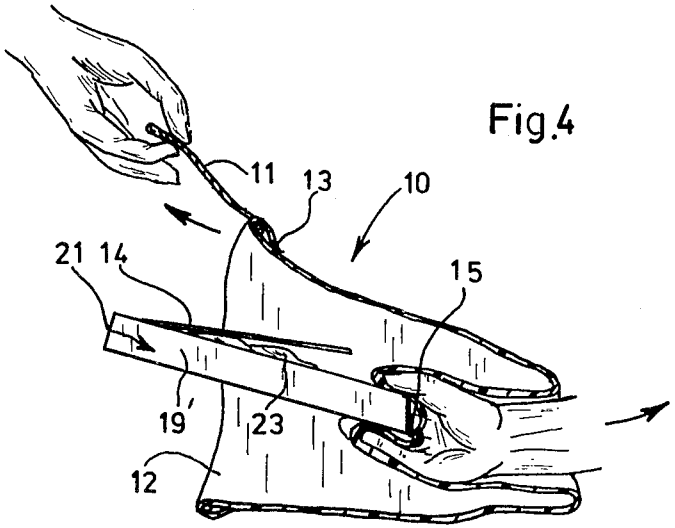
FIG. 4 is another view of the litter collector, partly in cross-section, shown during a second step of its operation.
Figure 5:
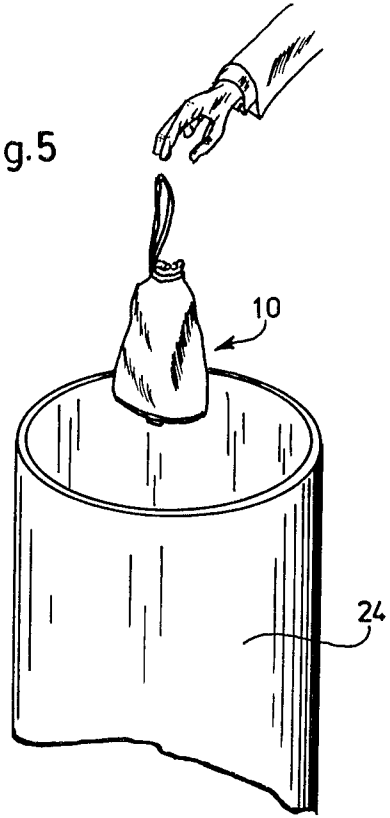
FIG. 5 shows the disposal of the collector.

Referring to FIGS. 1-5, there is shown the litter collector according to the present invention, consisting of a flexible bag 10 having at one end a pair of drawstrings 11, which fit into a seam 13 at the open end of the bag. The opposite end of the bag includes a closed seam 15, into which is fitted at center portion 16 a back edge 17 or portion of the back of a tapered scoop 21. Scoop 21 includes a tapered, collecting surface 20, having two vertical walls 19 and 19' along its tapered edges. At the back end of the scoop is provided a back edge 17, which is designed to fit into the center portion 16 of seam 15, so that the edge can be secured to the bag. Two triangularly-shaped tabs, 18 and 18', are folded out from walls 19 and 19' and are secured together, either by means of an adhesive or staple, so as to form an inclined back wall of the scoop. Tabs 18 and 18' are inclined slightly above surface 20. The scoop portion of the collecting device is designed to be smaller than the inside of bag 10. A triangularly shaped scraping tool 14 is also provided, so that the animal litter as shown in detail in FIG. 3, can be swept into the base 20 of the scoop in front of back supports 18 and 18'.

In operating the scoop according to the instant invention, the user inserts his hand through opening 12 of bag 10 and grips back edge 17 secured to seam 15. The scoop is sufficiently rigid so that it can be placed with the leading edge of surface 20 onto a flat surface adjacent to litter 23. Scraper or pusher 14 can then be placed on the other side of the litter, so that surface 20 can then be pushed under the litter for collection, between vertical walls 19 and 19'. As shown in detail in FIG. 4, scraper 14 is then placed on top of the collected litter 23, and the user with his other hand, pulls the bag over the entire scoop portion and then draws the strings tightly around opening 12, so that the opening is completely closed and the contents sealed. The entire contents can then be easily disposed of in a trash receptacle 24, as shown in detail in FIG. 5. The sealing of the bag entirely eliminates the smell of the animal litter, and the risk of bodily contact or contamination when it is disposed of in an open trash receptacle.

During the operation of the disposable litter collector of the present invention, the user's hands do not come into contact with the litter, even though the litter collecting operation is manually performed. The scoop or shovel portion and the scraper are preferably constructed of rigid chip board. Bag 10 is preferably constructed of black plastic or polyethylene.

In another embodiment, the shovel or scoop portion terminates in a back wall joining vertical walls 19 and 19', the back wall being adjacent to handgrip edge 17. The back wall then replaces the folded-in triangular strips 18 and 18'.

While only a single embodiment has been shown and described, it will be obvious that many modifications and changes may be made therein, without departing from the spirit and scope of the invention.

This invention is inexpensive to buy (only a few cents); easy to transport (in one's pocket); practical and easy to use (process takes three simple steps and only four seconds of time); eliminates the user's risk of getting hands or clothing contaminated; and further, is perfectly sealed after scooping and simple to dispose of. Additionally, it eliminates any offensive smearing or smell, thus facilitating a universal compliance with existing health laws on the part of the general populace.

What is claimed is:

1. A disposable animal litter collector, comprising:

a shovel-type scoop having a flat, supporting surface with a leading edge defining the opening of the scoop, vertical sidewalls on each side of the supporting surface, and a back wall joining the vertical sidewalls, said scoop including triangularly-shaped tabs secured to opposite sidewalls of said scoop, said tabs being directed toward each other and overlapping, and means for securing said tabs together to define said back wall of the scoop, and said supporting surface tapering inwardly from its leading edge;

a flexible bag having an opening at one end and closed at its opposite end, said bag additionally comprising a seam surrounding its open end, and a pair of drawstrings slidably disposed in said seam;

means for joining said scoop and the closed end of the bag together comprising a seam formed in said bag and secured to the back edge of said scoop; and a scraper.

2. The disposable litter collector as recited in claim 1, wherein said tabs are inclined with respect to the collecting surface of said scoop.

* * * * *